United States Patent [19]

Bräuning

[11] 4,200,332

[45] Apr. 29, 1980

[54] ADJUSTABLE CHAIR

[75] Inventor: Egon Bräuning, Weil am Rhein, Fed. Rep. of Germany

[73] Assignee: Protoned B.V., Amsterdam, Netherlands

[21] Appl. No.: 926,266

[22] Filed: Jul. 20, 1978

[30] Foreign Application Priority Data

Jul. 23, 1977 [DE] Fed. Rep. of Germany ..... 2733322

[51] Int. Cl.[2] ..... A47C 1/032

[52] U.S. Cl. ..... 297/300; 297/304; 297/355; 297/316; 248/619

[58] Field of Search ..... 297/300, 304, 305, 316, 297/355, 354; 248/400, 399, 561, 619

[56] References Cited

U.S. PATENT DOCUMENTS

| | | | |
|---|---|---|---|
| 2,615,496 | 10/1952 | Lorenz et al. | 297/300 |
| 2,707,986 | 5/1955 | Johnson | 248/400 X |
| 3,024,067 | 3/1962 | Brandoli | 297/355 |
| 3,249,330 | 5/1966 | Preis | 248/400 |
| 3,744,844 | 7/1973 | Nomaki et al. | 297/355 |
| 3,752,432 | 8/1973 | Lowe | 248/400 |
| 3,817,575 | 6/1974 | Bocksch et al. | 297/355 |

FOREIGN PATENT DOCUMENTS

| | | | |
|---|---|---|---|
| 981173 | 1/1976 | Canada | 297/355 |
| 1480485 | 8/1965 | Fed. Rep. of Germany | 297/316 |

*Primary Examiner*—Francis K. Zugel
*Attorney, Agent, or Firm*—Thomas R. Morrison

[57] ABSTRACT

A lockable gas cylinder in parallel with a mechanical spring controls the adjustment of tilt in a chair seat and back. A linkage mechanism permits tilting of the chair seat about a pivot located close to the forward edge of the seat and permits tilting of the back about a pivot which is located near the rear edge of the seat. The gas cylinder may be released to permit rocking of the chair against the force of the mechanical spring alone.

10 Claims, 5 Drawing Figures

ADJUSTABLE CHAIR

BACKGROUND OF THE INVENTION

The invention relates to an office chair having a seat and a back which can both be adjusted steplessly in their inclination in the same direction by operation of a lever acting through a gas cylinder.

The aim of chairs of this kind is to give support for the back of a person sitting on it in line with medical and ergonomic requirements. German Utility Model No. 7 331 431 describes a simple construction of an adjustable chair of this kind. The seat and the back of the chair described therein are rigidly interconnected. The horizontal axis of pivoting of the resulting unit extends centrally on the bottom of the seat surface because the axis of pivoting lies on the support column or pillar of the chair. Unfortunately, in this case the edge of the seat rises or falls quite considerably when the inclination or tilt of the chair is adjusted. The thighs of the sitter, which are borne by the front part of the seat, therefore also rise or fall considerably, with the result that the feet cease to be at the proper distance from the floor. The misadjustment must be corrected by a vertical adjustment of the seat, but vertical adjustability is not provided in the seat and would call for additional construction complications, quite apart form the extra problem that the sitter would have to make a simultaneous coordinated adjustment of seat height together with inclination.

An office chair disclosed by Swiss Patent Specification No. 524,982 helps to solve this problem. This chair forms the starting point for this invention. In this known chair the gas compression spring extends substantially parallel to the seat on the underside thereof, the axis of pivoting of the seat extending near the front edge thereof. The advantage of this feature is that the chair front edge makes little, if any vertical movement when the inclination of the seat and the chair back is adjusted. In this construction the gas compression spring is operated by way of a horizontally operable lever on the bottom of the seat. This is an unsatisfactory feature ergonomically. Also, it is impossible to rock in this chair—i.e., to carry on making the adjustment of the seat and chair back in the same direction, as previously referred to, for as long as required; for this purpose the lever which operates the gas compression spring would have to be pulled all the time—an impossibility. When the front part of the seat is loaded, the chair back of this construction remains in its original position despite operation of the gas spring.

SUMMARY OF THE INVENTION

Starting from a chair of the kind described, therefore, it is an object of the invention so to develop the chair as to improve it ergonomically and more particularly to make it possible to rock in the chair. It is required to retain the advantages of the seat being pivoted near its front edge and the advantages of stepless adjustability of inclination. Another requirement is that when the chair is loaded in the front part of the seat, the chair back should pivot forward automatically with the seat when the gas spring has been operated.

According to the invention, therefore, a mechanical compression spring is provided in parallel to the gas compression spring and the lever is lockable in the open position of the gas pressure valve.

This paralleling of the gas compression spring and mechanical compression spring—i.e., helical spring—leads to the spring rates of the two springs so cumulating that the invention achieves its aim. While with the valve open the gas spring produces a pressure which remains constant substantially irrespective of actual inclination, the pressure applied by the mechanical compression spring increases with increasing compression thereof—i.e., with increasing adjustment of inclination. The two spring rates or characteristics so add together that a pleasant rocking motion is possible. A contributory factor is that the lever can be locked with the gas pressure valve in its open position—i.e., the sitter does not need to keep the lever operated the whole time but can lock it in the "rocking" position. To lock the seat and back in any particular inclined position, all that is necessary is to release the locking of the lever so that the gas spring valve closes.

To adapt the spring rate to the mechanical compression spring, the resilience thereof is preferably adjustable.

Preferably too, the operable end of the lever is adapted to be operated substantially vertically. Vertical operation is better ergonomically than the prior art horizontal operation.

According to another important feature of the invention, in the front part of the seat a lever arm is pivoted to the links and responds to a vertical force applied there by pivoting the chair-back forwards. This solves the secondary problem of the chair back pivoting forwards automatically, in response to loading of the front part of the seat and with the gas spring in operation, until the chair back abuts the back of the sitter.

As a very simple form of construction to achieve this aim, the lever arm forms part of a double-armed lever fulcrumed on the chair frame, the other arm of such lever being pivotally connected to a rod whose other end is pivotally connected to a lever arm formed on the chair back. A link is therefore provided which transforms the pivoting of the lever arm into a pivoting in the same direction of the chair back. As previously mentioned, during this pivoting movement the rearward part of the chair seat rises in the same direction.

So that the chair back can rock automatically in this position, the lever for operating the gas compression spring is, with advantage, lockable in its open position, as previously mentioned.

To ensure that the transmission of forces and the pivoting movements described proceed in conditions of loadability and stability, it is preferred that the double-armed lever, the rod and the lever arm of the chair back each take the form of a double two-armed lever, a double rod and a double lever arm, respectively, in spaced-apart relationship to one another.

In a preferred form for transmitting the forces between the springs and the pivoting members, the gas compression spring and the mechanical compression spring engage at one end with a pivot providing a pivotal connection between the rods and the lever arms of the chair back and at the other end with a shaft rigidly connected to the seat.

Conveniently, the shaft is connected via links to the chair frame. Other components of the chair, such as the levers controlling adjustment of the chair back and chair seat in the same direction and for controlling vertical adjustment of the chair, can be connected to the links.

BRIEF DESCRIPTION OF THE DRAWINGS

The invention will be described hereinafter in greater detail with reference to an embodiment, with a disclosure of other important features. In the drawings.

DETAILED DESCRIPTION OF THE PREFERRED EMBODIMENT

Figure 1:
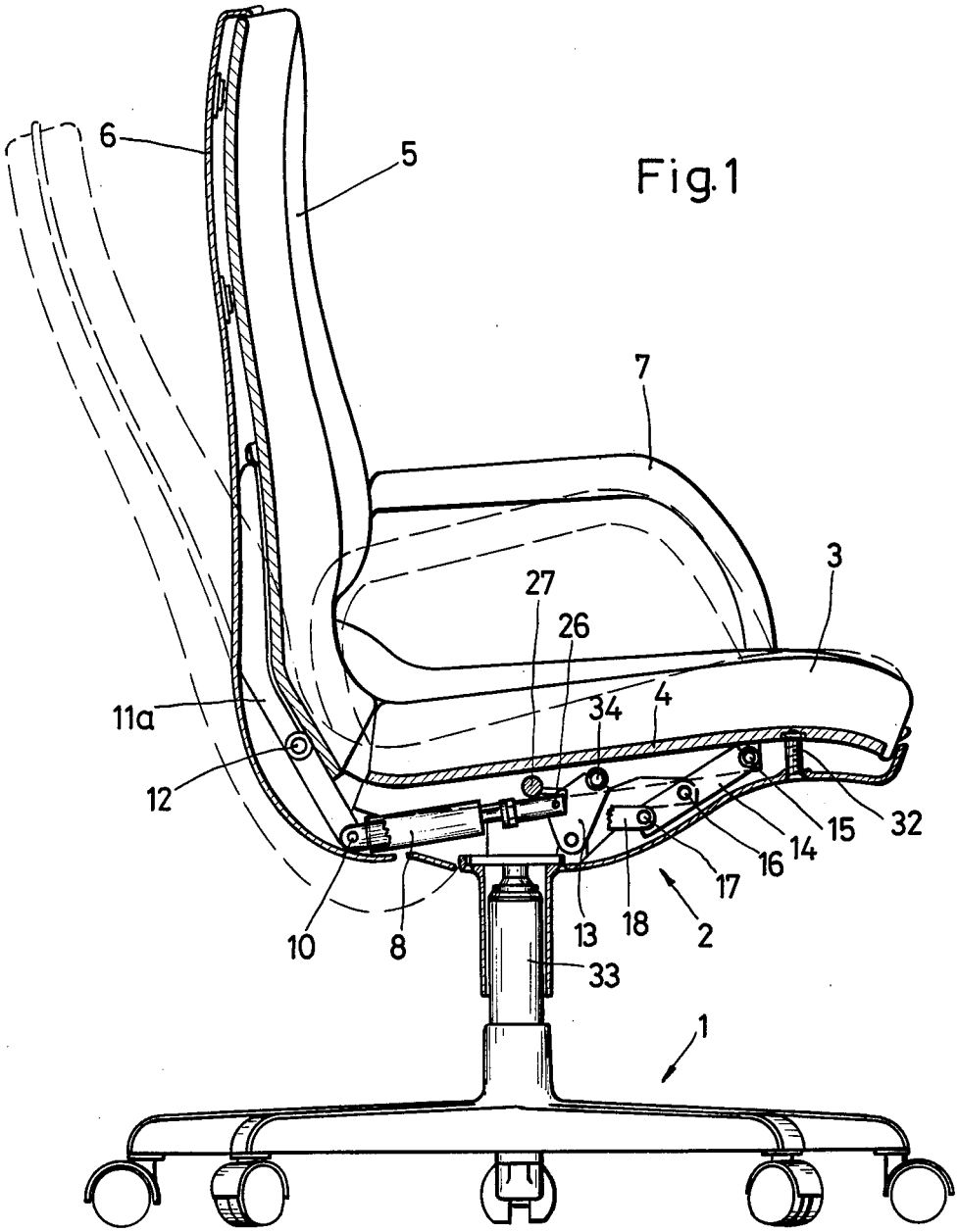
FIG. 1 is a partly sectioned side view of an office chair according to the invention, the seat and the chair back being shown in two positions.

A description will first be given with reference to FIG. 1 of the basic construction of the novel chair. A frame 2 is mounted for rotation and vertical adjustment on an underframe 1 having rollers. Frame 2 carries a seat 4, having seat upholstery thereon, and a chair back 6, also having upholstery 5 thereon. Arm rests 7 are secured to seat 4. These components—i.e., the seat 4, back 6 and arm rests 7—are shown in FIG. 1 in solid lines in one end position and in dashed lines in their other end position. As shown the seat 4, rests 7 and the chair back 6 can be adjusted in the same direction as one another—i.e., synchronously to one another.

Figure 2:
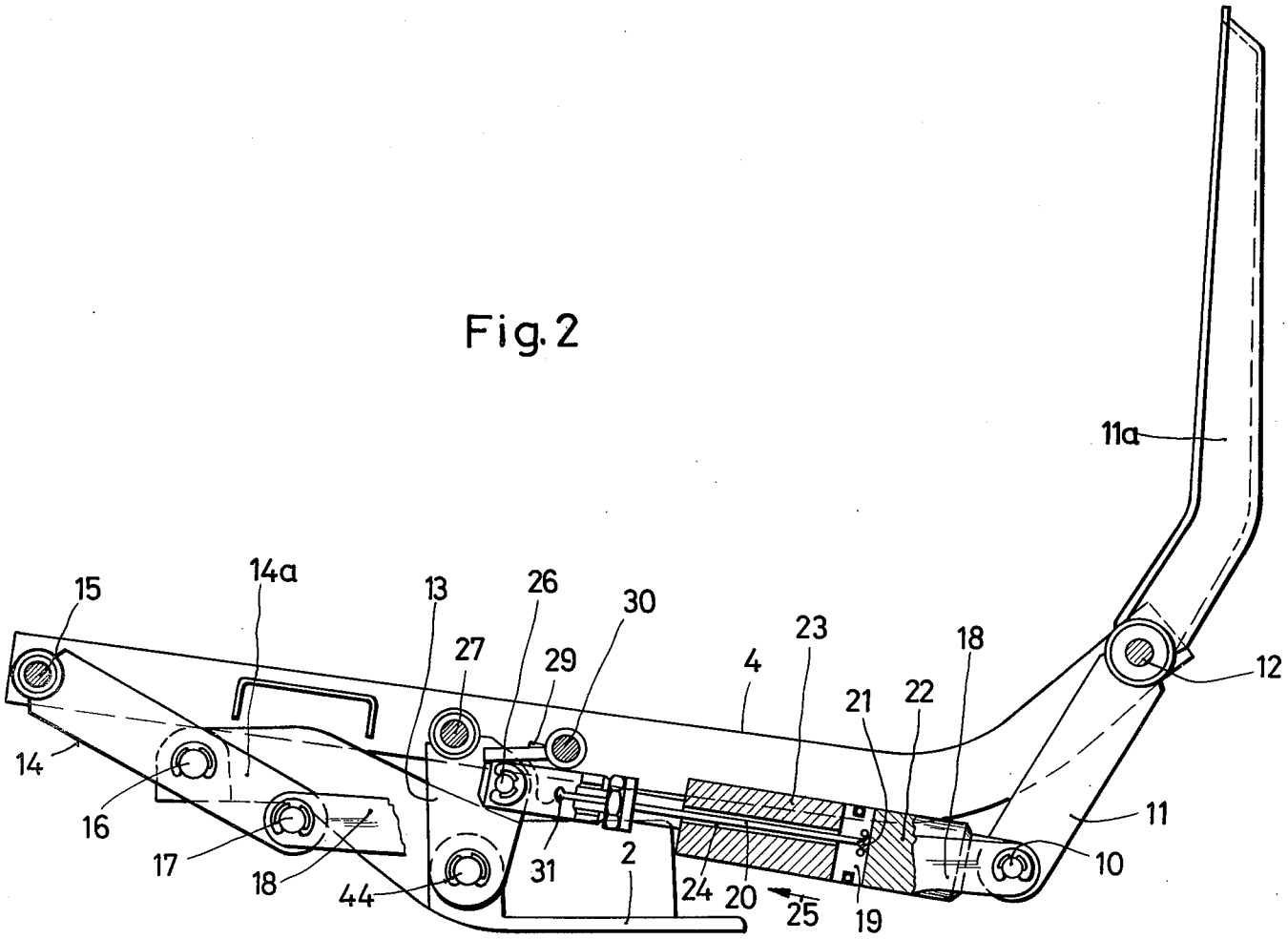
FIG. 2 is a detail view to an enlarged scale to illustrate the operation of the means providing adjustment of the chair seat and chair back in the same direction.
Figure 3:
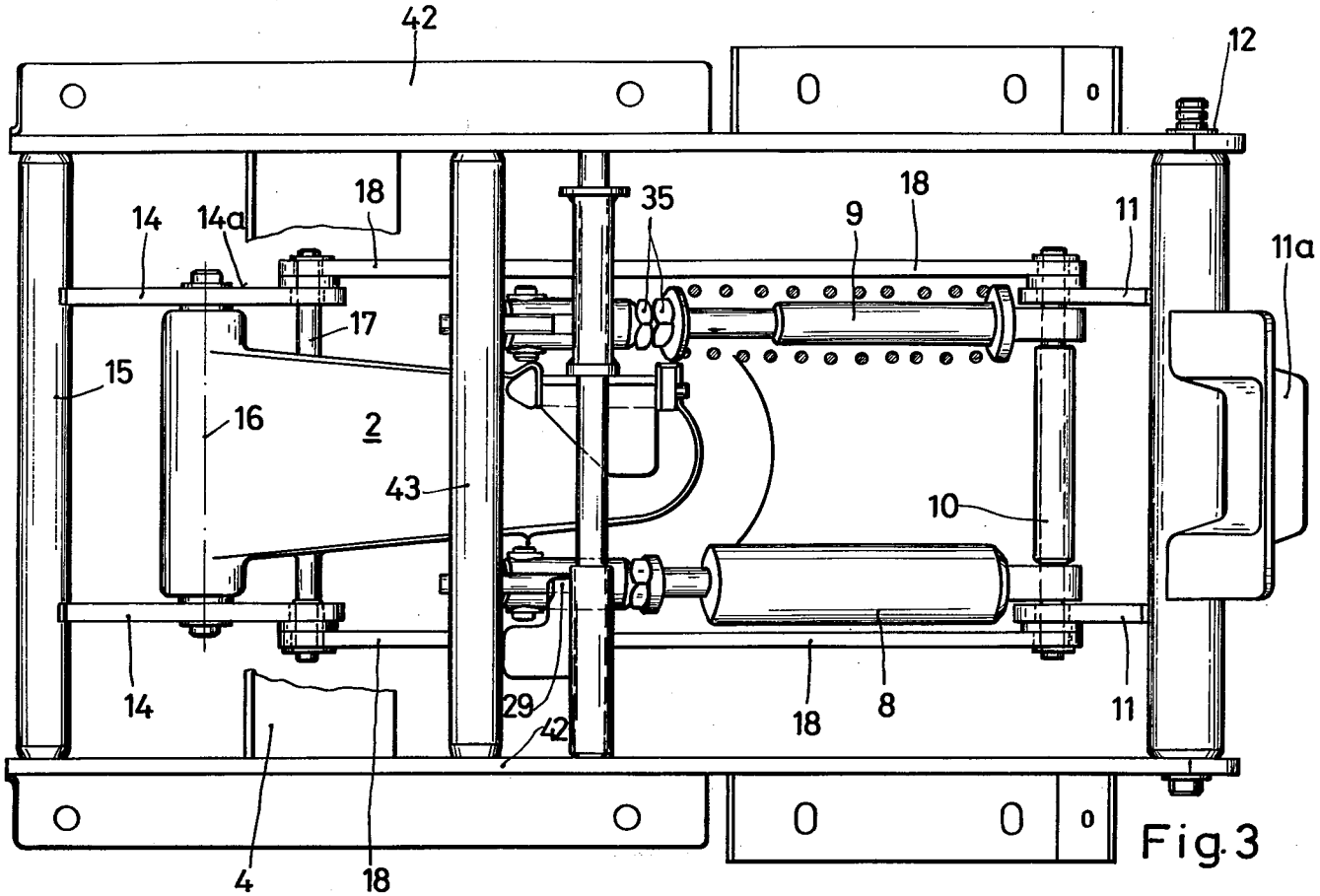
FIG. 3 is a plan view corresponding to FIG. 2 without retaining means for the chair back.

To this end, a spring mechanism, to be described in greater detail hereinafter with reference to FIGS. 2 and 3, is disposed below and substantially parallel to the seat 4. FIG. 1 shows a gas compression spring 8 of the spring mechanism. As can be gathered from FIG. 3, a mechanical compression spring 9 is disposed parallel to the gas spring 8. The two springs 8, 9 have their rear ends connected to a common rod 10 pivotally connected to bottom lever arms 11 of a two-armed lever. The two arms 11 are mounted for pivoting around a pivot 12 and are rigidly connected to a section member 11*a* forming the top lever arm. Member 11*a* is screwed to the shell or frame of chair back 6.

The front ends of the two springs 8, 9 are connected to two triangular flanges 13 pivotally connected at one end to the frame 2 by way of bearings 44 and at the other end by way of a rod 43 to plates 42 secured to the shell or frame of the seat 4.

A lever arm 14 of a double-armed lever is pivotally secured to a bearing 15 of seat 4. The two arms 14 are pivotally mounted on frame 2 by way of a bearing 16. The other ends 14*a* of the arms 14 are pivotally secured by way of pivots 17 to rods 18. The rods 18 have their other ends pivotally connected by way of rod 10 to arms 11. For the sake of clarity in the drawing, the rods 18 are represented in FIG. 2 merely by their front ends.

The gas spring 8 is of a conventional construction in which a piston 19 inside it (see FIG. 2) has a continuous central axial passage; extending therethrough is a rod 20 whose rear end thickens to form a cone 21. In the position shown in FIG. 2, cone 21 is in sealing-tight engagement with its seat in the passage. When the rod 20 and therefore the cone 21 move rearwardly from the position shown, the passage opens because its diameter is greater than the diameter of rod 20. The pressures in the rear chamber 22 and front chamber 23 of the gas spring 8 therefore equalize so that the same ceases to exert any force. With the valve in the closed position shown, the gas pressure in the chamber 22 urges the piston 19, and therefore a hollow rod 24 around the rod 20, forward in the direction indicated by an arrow 25. Since the front end of the gas spring 8 is pivoted to the casing by way of the flange 13 and pivot 26, the result of the forwards movement of the rod 24 is that the bottom end of lever 11 pivots rearwardly—i.e., into the chair-back position shown in solid lines in FIG. 1.

Consequently, during this movement the distance between the pivots 10 and 26 increases; consequently, the links 14, 14*a*, 18 move into a straight-line position and the seat 4 moves in synchronism into its solid-line position. The pivoting axis of the seat 4 is therefore the pivot 15. The pivoting axis of the chair back 6 is the pivot 12.

Figure 4:
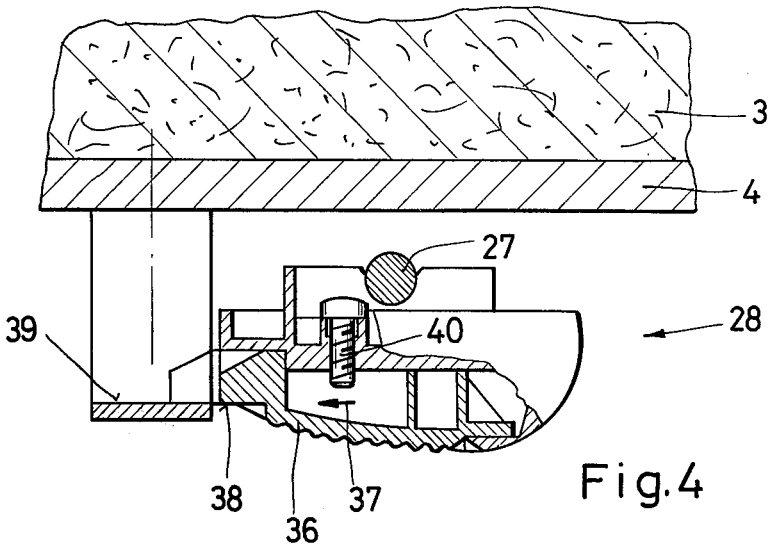
FIG. 4 is a view similar to FIG. 2 to illustrate another detail.
Figure 5:
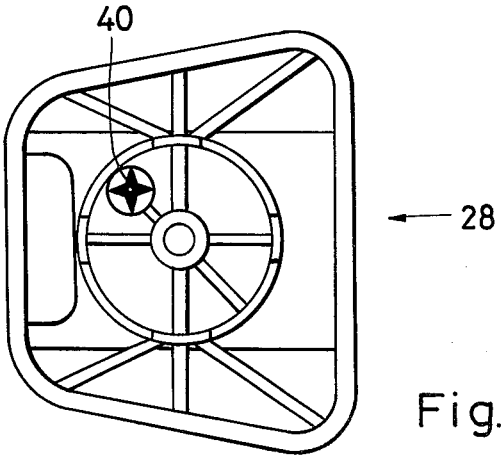
FIG. 5 is a plan view of the lever used in FIG. 4.

The gas pressure valve is operated by means of a two-armed lever 27 having a grip 28 at its free end, as can be gathered from FIGS. 4 and 5. The free end of lever 27 acts on a member 29 pivotally mounted on a shaft 30. When the grip 28 is pulled up, the other end of lever 27 moves member 29 down so that the same pivots rearwardly and anticlockwise in relation to FIG. 2. Rod 20 therefore moves to the left to open the valve in the gas spring 8, since the bottom end of member 29 engages with the free end 31 of rod 20. The result is the pivoting movement in the same direction, as hereinbefore described, of the chair back 6, arm rests 7 and seat 4. As FIG. 1 shows, the front part of the seat 4 rises very little since its pivoting axis 15 is disposed near the front of the seat 4.

The frame 2 and seat 4 are screwed together by screws 32.

The chair is also vertically adjustable and accordingly has in a tubular column or pillar 33 of the underframe 1 another gas compression spring which, as hereinbefore described with reference to the spring 8, can be operated by a lever 34. When the grip end thereof is tightened, the valve of the gas spring used for vertical adjustment opens and the height of the chair can be adjusted. When the grip end of the lever 34 is released, the valve closes and the chair remains at the height to which it has been adjusted.

The spring rate of the parallel mechanical spring 9, which is a helical spring, can be adjusted by means of nut 35.

If the grip 28 is required to be locked in its raised position—i.e., the position in which the chair can rock because the gas spring valve is open—a slider 36 on the key 21 is operated (see FIG. 4). For this purpose, the member 36 is moved outwards, in the direction indicated by an arrow 37, so that its surface 38 abuts a matching surface 39 rigidly secured to the seat 4. The surface 39 is the base or cross-arm of a U section member rigidly secured to the seat 4. To facilitate operation the member 36 has a fluted underside. The travel of the member 36 is determined by a screw 40 screwed into the grip 28. Consequently, operation of the members 28, 36 enables the valve of the gas spring 8 to be kept open.

In a preferred embodiment a compression spring 9 having a spring travel of 13 mm and a spring force of 123 kp at a length of 23 mm was used. The spring force at 10 mm length was 54 kp. The preloading or biassing was 10 meters.

With the valve of the gas spring 8 open, the chair back 6 automatically pivots forwards under the weight of the sitter when the latter sits on the front of the seat 4, for in this position the sitter's weight acts via the front of the seat 4 on the two parallel lever arms 14 and pivots the same anticlockwise (in FIG. 2) together with the arms 14*a*. The linkage embodied by the members 14, 14*a*, 18 moves into a straight-line position and the arm 11 with the member 11*a* also pivots anticlockwise, so that the chair back 6 pivots forwards.

It is important for the mechanical spring 9 to boost the effect of the gas spring 8. This is why the two springs 8, 9 of the embodiment shown are in parallel with one another.

However, they can be at an acute angle to one another subject to both springs having force vectors which are additive. The two springs need not be placed one beside another as they are so placed in the drawings. Reasons of space may make it preferable for the mechanical spring 9 to be pushed over the gas spring 8. Also, the two springs can be disposed one after another. The skilled addressee may therefore make use of all the conventional arrangements of the two springs the scope of the invention, subject to the operation hereinbefore described being achieved.

What is claimed is:

1. A chair comprising: a seat, a back, a pedestal, pivoting means for connecting said seat and back to said pedestal for rocking motion about a substantially horizontal axis, adjustment means for steplessly adjusting the inclination of said seat and back in the same direction said adjustment means including a gas cylinder, and a mechanical compression spring having a spring force which is additive to the force from said gas compression cylinder, and boosts the effect thereof, and lockable valve means for alternatively locking said gas compression cylinder in an open and a closed position, said open position providing substantially constant force whereby a pleasant rocking motion is possible and said closed position providing substantial force resisting motion of said seat and back whereby said seat and back are locked in a selected substantially fixed inclined position.

2. A chair according to claim 1, further comprising means for adjusting the spring force of said spring.

3. A chair according to claim 1 further comprising a lever in said adjustment means and said lever being vertically operated.

4. A chair according to claim 1 wherein said pivoting means comprises a first pivot near the front part of said seat and a second pivot near the rear part of said seat, lever means linked to said first and second pivots for pivoting the chair back forward about said second pivot and for pivoting said seat forward about said first pivot in response to a downward force on the front of said seat.

5. A chair according to claim 4, wherein said lever means forms part of a double-armed lever fulcrumed on the chair frame, one arm of said lever being pivotally connected to a rod whose other end is pivotally connected to a lever arm formed on the chair back.

6. A chair according to claim 5, wherein said double-armed lever, rod and lever arm of the chair back each take the form of a double two-armed lever, a double rod and a double lever arm, respectively, in spaced apart relationship to one another.

7. A chair according to claim 6, further comprising said gas compression cylinder and spring each engaging at one end with a pivot providing a pivotal connection between said rods and the lever arms of the chair back and at the other end of said gas compression cylinder and spring engaging a shaft rigidly connected to the seat.

8. A chair according to claim 7, wherein the shaft is connected via links to the chair frame.

9. A chair comprising:

(a) a pedestal;

(b) a seat;

(c) a back:

(d) pivotable means for connecting said seat and back to said pedestal for rocking notion about a substantially horizontal axis.

(e) a gas compression cylinder in said pivotable means;

(f) a valve in said gas compression cylinder, said valve having a lockable open condition wherein said gas cylinder is effective for resisting pivotable motion of said seat and back with a constant force and a lockable closed condition, effective for substantially fixing said seat and back in a selectable inclined position;

(g) a mechanical compression spring in said pivotable means; and (h) means for connecting at least a component of force of said mechanical compression spring additively with said resisting by said gas compression cylinder whereby a pleasant rocking motion is possible.

10. The chair recited in claim 9 further comprising vertical adjustment means for adjusting the height of said seat and back.

* * * * *